US005211126A

United States Patent [19]

Johnson

[11] Patent Number: 5,211,126

[45] Date of Patent: May 18, 1993

[54] SHIP OR BOAT CONSTRUCTION HAVING THREE HULLS

[76] Inventor: Robert K. Johnson, 10733 Spring St., Largo, Fla. 34644

[21] Appl. No.: 884,672

[22] Filed: May 18, 1992

[51] Int. Cl.[5] ..... B63B 1/20

[52] U.S. Cl. ..... 114/61; 114/288; 114/290; 114/291

[58] Field of Search ..... 114/56, 57, 61, 123, 114/274, 278, 291, 288, 290, 283

[56] References Cited

U.S. PATENT DOCUMENTS

| | | | |
|---|---|---|---|
| 3,296,992 | 1/1967 | Lackenby | 114/61 |
| 3,885,514 | 5/1972 | Lauenborg | 114/61 |
| 4,655,157 | 4/1987 | Sapp | 114/291 |
| 4,924,797 | 5/1990 | Solia | 114/291 |

*Primary Examiner*—Joseph F. Peters, Jr.
*Assistant Examiner*—Stephen P. Avila
*Attorney, Agent, or Firm*—Joseph C. Mason, Jr.; Ronald E. Smith

[57] ABSTRACT

A catamaran design has a third hull positioned between the conventional hulls. The third hull has a length equal to about two-thirds of the length of the conventional hulls, and a recess is formed in the underside of the deck aft of the third hull. The recess has a depth sufficient to accommodate the rooster tail created by the third hull. The third hull enhances the buoyancy of the craft and prevents formation of waves under the leading end of the deck. The recess prevents the rooster tail from impinging against the underside of the deck. The third hull produces a concave wake and it is submerged to a similar extent as the twin hulls when the watercraft is at rest floating in a body of water. In combination, the third hull and recess provide a catamaran that can handle heavy seas, with control and safety, that is not subject to the pounding of waves on the underside of its deck, and which performs in all other respects like a conventional catamaran.

4 Claims, 5 Drawing Sheets

SHIP OR BOAT CONSTRUCTION HAVING THREE HULLS

BACKGROUND OF THE INVENTION

1. Field of the Invention

This invention relates to improvements in watercraft of the catamaran type. More particularly, it relates to a catamaran having a third hull.

2. Description of the Prior Art

Catamarans are twin-hulled boats that may be propelled by the wind, by motors, or both; the hulls are laterally spaced apart from one another and are connected by a deck means. The deck may be a rigid, structural part of the craft, or it may be a framework covered by a suitable fabric. In some boats or ships, the deck may be a combination of fabric and rigid materials.

The invention disclosed hereinafter relates primarily to improvements in the design of catamarans having rigid, structural decks, but it also has utility in connection with catamarans having nonstructural decks as well.

There are two problems that are inherent in catamaran design. The first problem relates to the pounding that the underside of the deck takes in high seas and the concomitant unpleasant effect such pounding has on the passengers, both as to noise and impact. A very large catamaran is less subject to this problem because the underside of its deck is high above the waves. Thus, there is a need for a design that alleviates this problem in all but the largest catamarans. The second problem relates to the tendency of the bow of all but the largest catamarans to become submerged either as a result of high seas or as a result of strong winds, i.e., a sailing catamaran bow may become submerged even in calm water from the force of the sail if the wind is strong. A submerged bow results in loss of control and possible capsize. Accordingly, there is a need for a catamaran design that would prevent bow submersion or, at least, provide quick recovery in the event high seas or strong winds cause such bow submersion.

Earlier inventors have added a third hull to catamarans in an attempt to alleviate both of these problems. However, the known three hull designs include a third hull that is submerged only when encountering waves, i.e., such third hulls are not submerged in calm water. Such third hulls attenuate the force of the waves pounding on the underside of the deck at least to some extent and they add buoyancy to the bow, but they do not solve these problems entirely.

U.S. patents showing multiple hull boats include Design U.S. Pat. No. 191,020 to Fry and utility U.S. Pat. No. 3,345,967 to Sweet. U.S. patents disclosing extra keels include U.S. Pat. Nos. 3,773,006 to Black, 3,469,549 to Rae, 3,902,445 to Stolk, and 1,620,349 to Hickman.

Still further U.S. patents of interest include U.S. Pat. Nos. 2,735,392, 4,890,564, Des. U.S. Pat. Nos. 236,145, 4,903,626, 911,806, 4,091,761, 4,924,797, 3,702,598, 4,233,920, and 4,932,347.

Foreign patents of interest include United Kingdom Nos. 471,741, 1,407,426, 1,541,639, and France Nos. 2,571,330, 1,025,312, and 2,636,295.

Although these designs represent improvements over conventional, twin-hulled catamarans, they still have shortcomings. For example, some of them include third hulls that extend the entire length of the watercraft; obviously, this adds a considerable amount of manufacturing expense. Perhaps more importantly, such full-length third hulls change the performance characteristics of the watercraft so much that the craft is no longer recognizable as a catamaran.

Still other designs incorporate third hulls that extend from the bow of the boat to a point about mid-length thereof and which are submerged only momentarily when encountering waves. These hulls are provided to assist in the planing of the craft over the water. These craft are known as planing boats because they skim over the surface of the water.

Thus, none of the known designs include fully submerged third hulls that extend less than the full length of the craft.

What is needed, then, is a three hull design that provides the buoyancy of a three hull craft without detracting from the performance of the craft. The ideal design would also vitiate the pounding of the waves on the underside of the deck, even though the ideal third hull would not extend the entire length of the craft. However, at the time the present invention was made, the prior art, when considered as a whole as required by law, neither taught nor suggested to those of ordinary skill in the boat building industry how the ideal design could be achieved.

SUMMARY OF THE INVENTION

A third hull that extends about two-thirds the length of a catamaran is added thereto at the leading end thereof to provide additional buoyancy to the front or bow region of the craft without unduly inhibiting its performance characteristics. A recess is formed in the underside of the deck in the area trailing the third hull so that a spray or "rooster tail" generated by the third hull is received by said recess. Thus, the only water that contacts the underside of the deck in the recess area is a fine mist, i.e., the remnants of the central rooster tail. Thus, the power of the mist impinging on said underside is too nominal to be heard or felt by the passengers on the craft.

Significantly, the size of the waves aft of the third hull are so small as to be negligible. The novel third hull, being fully and not just partially submerged as in the planing boats of the prior art, creates a calm, concave wake as it passes through the water.

Thus it is seen that the primary object of this invention is to provide the world's first three-hulled catamaran that generates a central rooster tail effect and which accommodates said rooster tail so that it does not impinge with any appreciable force against the underside of the boat's deck.

Another object is to provide a fully submerged third hull that produces a central concave, waveless wake between the hulls.

Other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
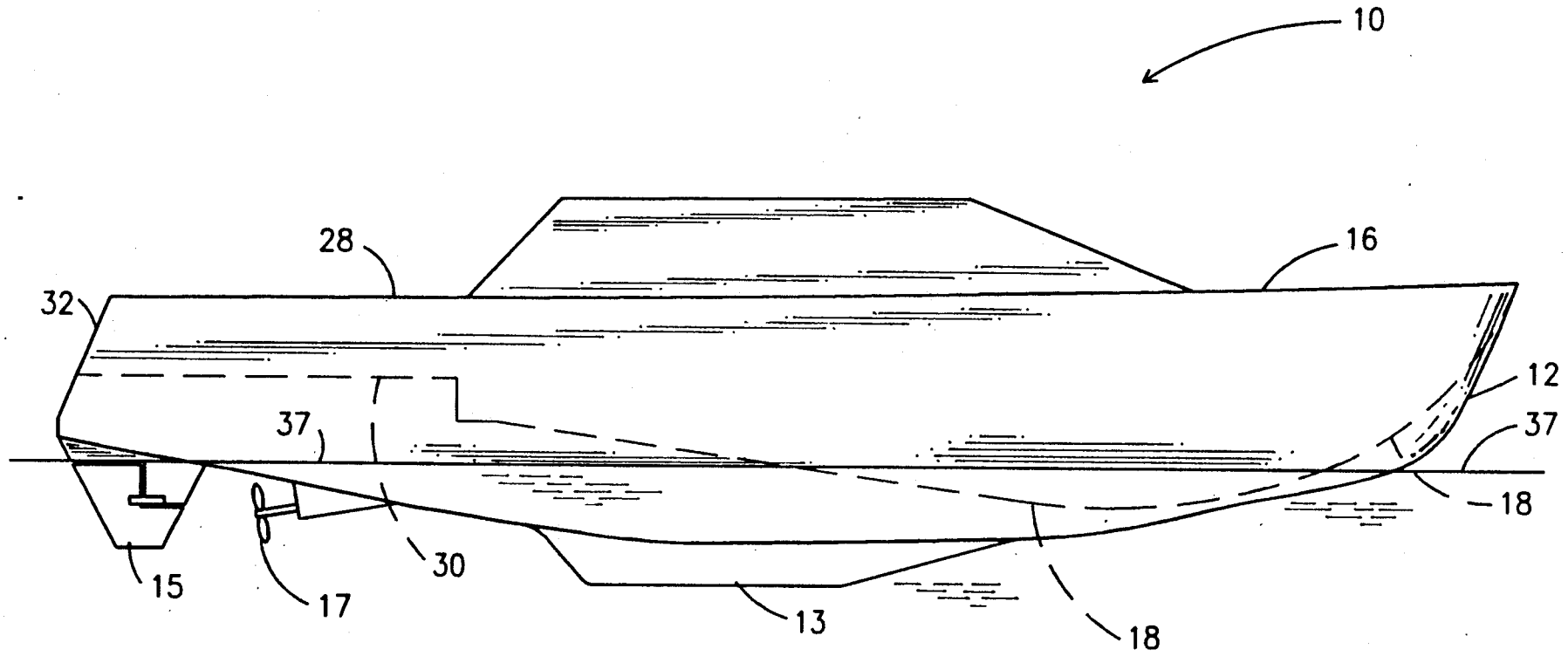
FIG. 1 is a side elevational view of the novel catamaran when at rest in a body of water.

Referring now to the Figs., it will there be seen that the novel boat design is denoted by the reference numeral 10 as a whole. Laterally spaced apart hulls 12, 14 are conventional and support deck 16 in the well known way. As perhaps best shown in FIG. 3, they extend the entire length of the watercraft. Reference numeral 13 collectively indicates either fixed position keels or moveably mounted centerboards that depend from hulls 12, 14. The rudders are denoted 15 and the propellers are denoted 17.

The novel third hull is denoted 18 as a whole. Note in FIG. 4 that it could also be provided with a keel or centerboard 13; the provision of keels and centerboards is dependent upon design considerations that form no part, per se, of the present invention. For example, movably mounted centerboards are often provided for sailing vessels, whereas motor-powered craft may be provided without keels. The leading end 20 of third hull 18 is substantially coincident with the respective leading ends 22, 24 of hulls 12, 14, but its trailing end 26 terminates about two-thirds of the way from the bow to the stern of the craft 10 as perhaps best shown in FIG. 3. In other words, the central hull is about two-thirds the length of the conventional hulls.

The trailing end 28 (FIGS. 1 and 2) of deck 16 has a recess 30 formed therein aft of hull 18. In the preferred embodiment, the recess 30 has a rectangular shape as perhaps best shown in FIG. 3 and its depth depends upon the size of the watercraft; for example, a recess 30 having a depth of about one foot is sufficient for a craft in the thirty-thirty five foot range. It extends substantially from the trailing end 26 of the third hull 18 to the stern 32 of the craft, and its width is substantially equal to the distance between the conventional hulls 12, 14. That depth is sufficient to fully or substantially receive the rooster tail 35 (FIG. 2) created by the third hull 18 when the craft is underway so that the force of its impingement upon the underside of the deck is nominal.

Figure 4:
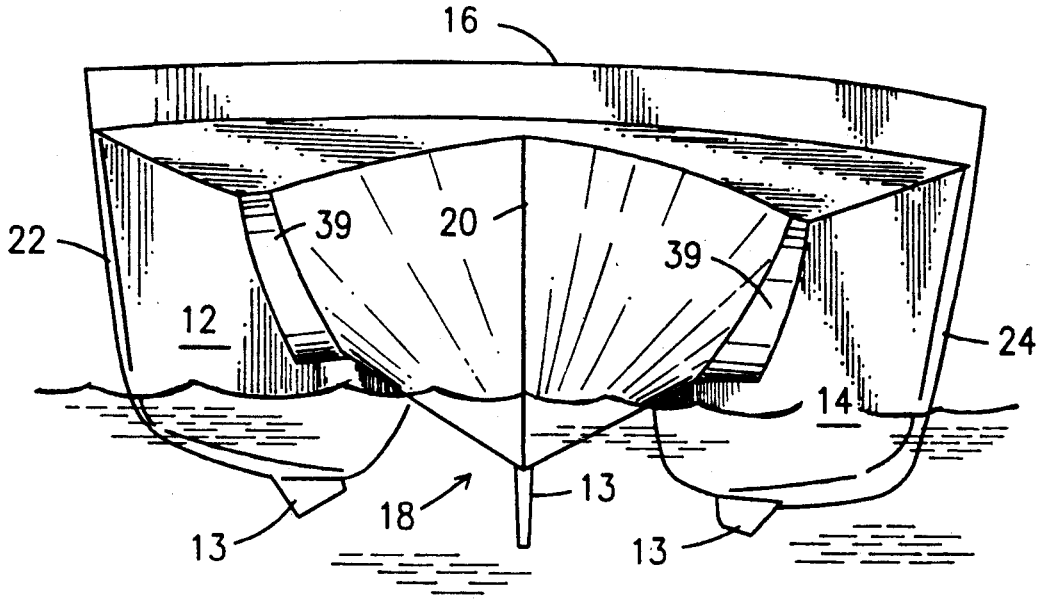
FIG. 4 is a front perspective view thereof.
Figure 5:
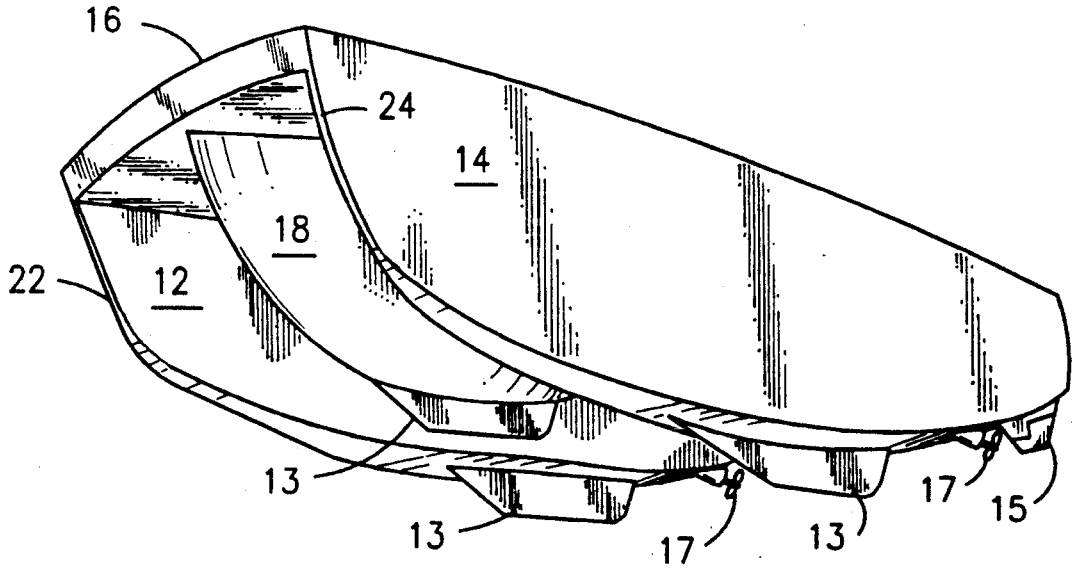
FIG. 5 is a three-quarter frontal perspective view thereof.
Figure 8:
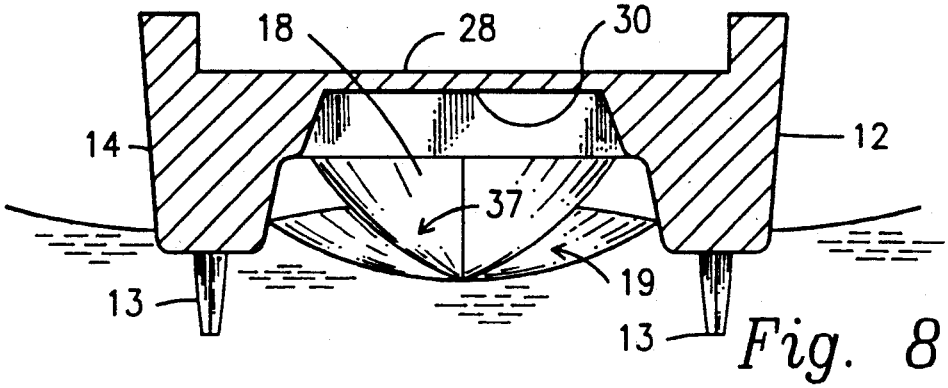
FIG. 8 is a rear elevational view showing the concave wake produced by all embodiments of the novel craft.

As shown in the frontal view of FIG. 4, the waves that form between central hull 18 and the conventional hulls 12, 14 are small in size because said hull 18 preempts the space between them where larger waves form in catamarans lacking said third hull. Just as importantly, as depicted in the rear elevational view of FIG. 8, central hull 18 produces a substantially waveless, concave wake, generally denoted 19. Wake 19 also reduces the wave height behind the conventional hulls 12, 14. This concave wake is produced by no prior art designs for catamarans having a third hull because the elevated, i.e., not normally submerged third hulls of the planing boats do not produce this important phenomenon. As used herein, "fully submerged" means submerged to a similar degree as the conventional twin hulls when the vessel is at rest. Thus, in the novel design of this invention, there is little or no impinging of waves on the underside of the deck. Just as importantly, the third hull adds a substantial amount of buoyancy to the forward end of the craft, so that it can handle rough seas with control and safety.

The frontal view of FIG. 4 also reveals that the conventional hulls 12 and the novel central hull 18 have a common height extent, i.e., the respective bottom edges of said hulls are disposed in a common horizontal plane.

Figure 2:
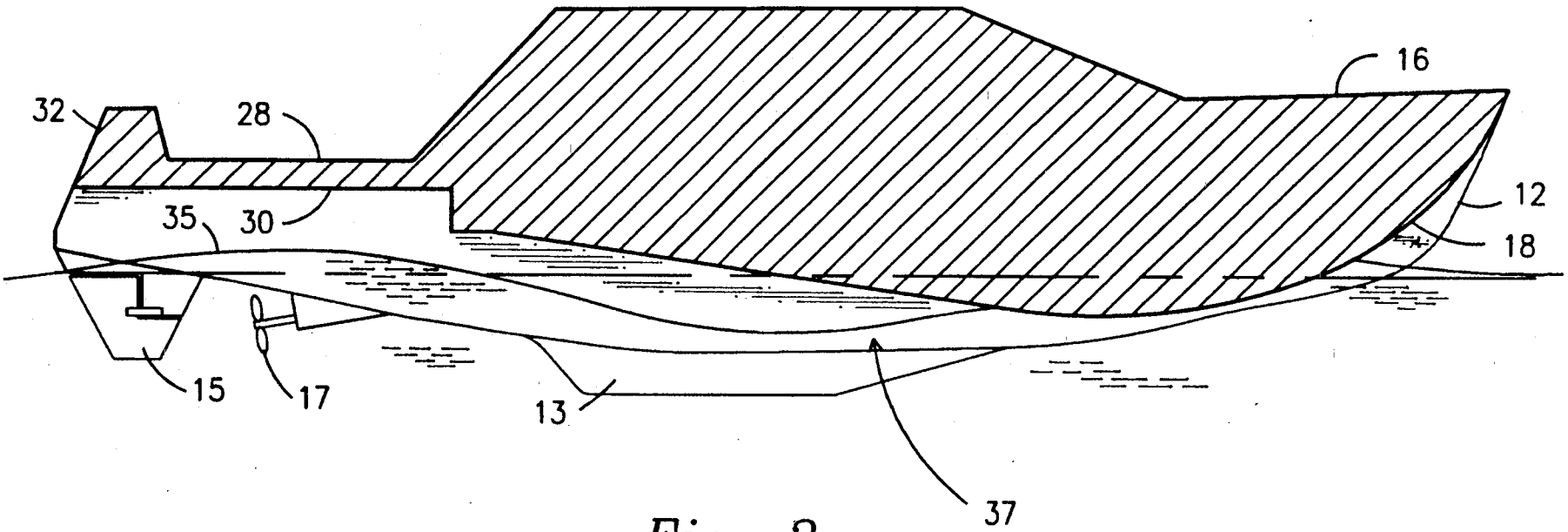
FIG. 2 is a side elevational view thereof when underway in a body of water.

The central rooster tail effect is perhaps best understood by comparing FIGS. 1 and 2 which show the craft 10 at rest and underway, respectively. In both FIGS., the water line is denoted 37 as a whole. The water line is of course flat in FIG. 1, but the shape thereof changes as depicted in FIG. 2 as the craft begins to move. At high speeds, rooster tail 35 will rise even higher than depicted in FIG. 2, but the depth of recess 30 is such that it is merely a fine spray when it strikes the underside of the trailing part 28 of the deck, as aforesaid.

Figure 3:
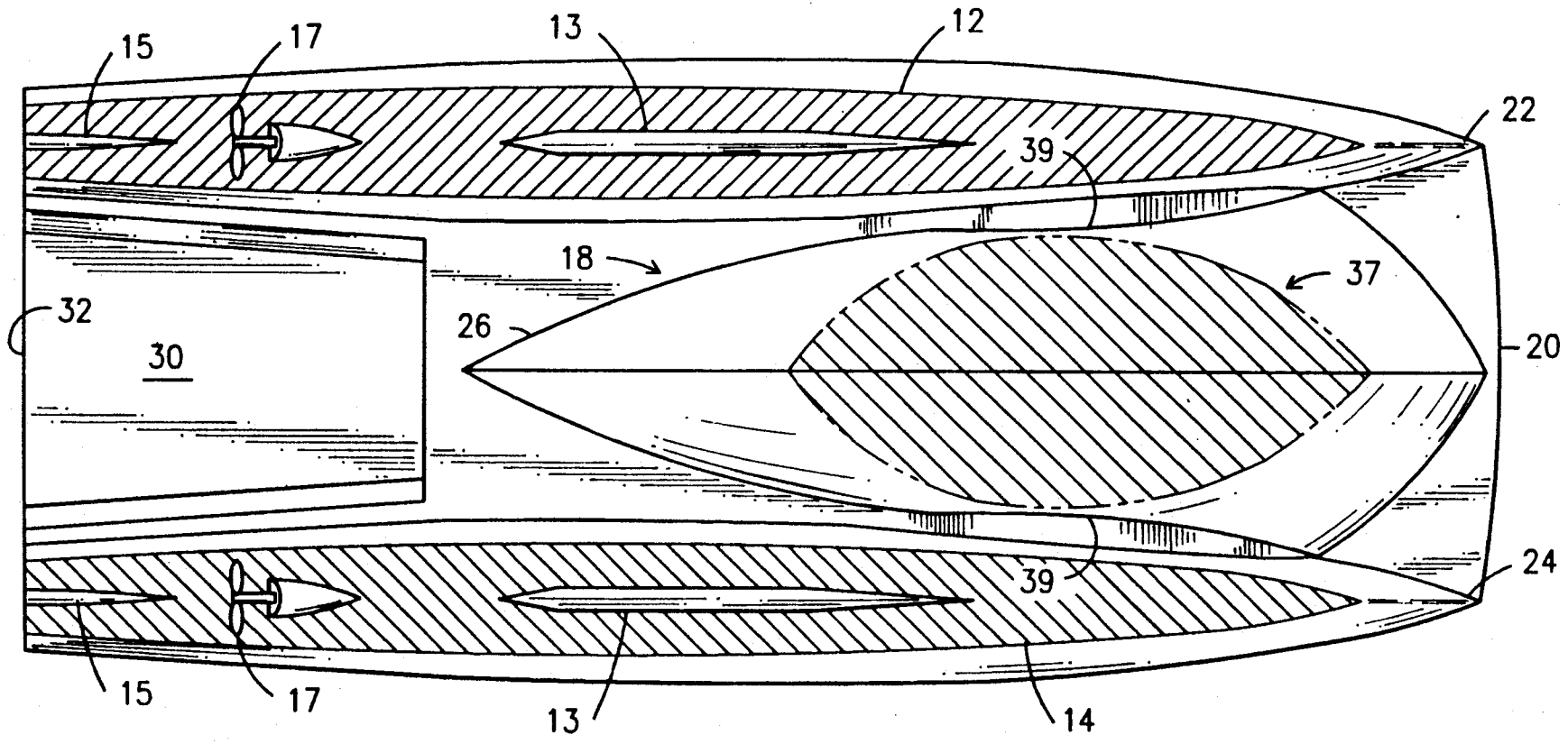
FIG. 3 is a bottom plan view thereof.

A dished section 39 is formed in each side of the third hull as shown in FIG. 3; the dished sections accommodate the conventional hulls.

Figure 6:
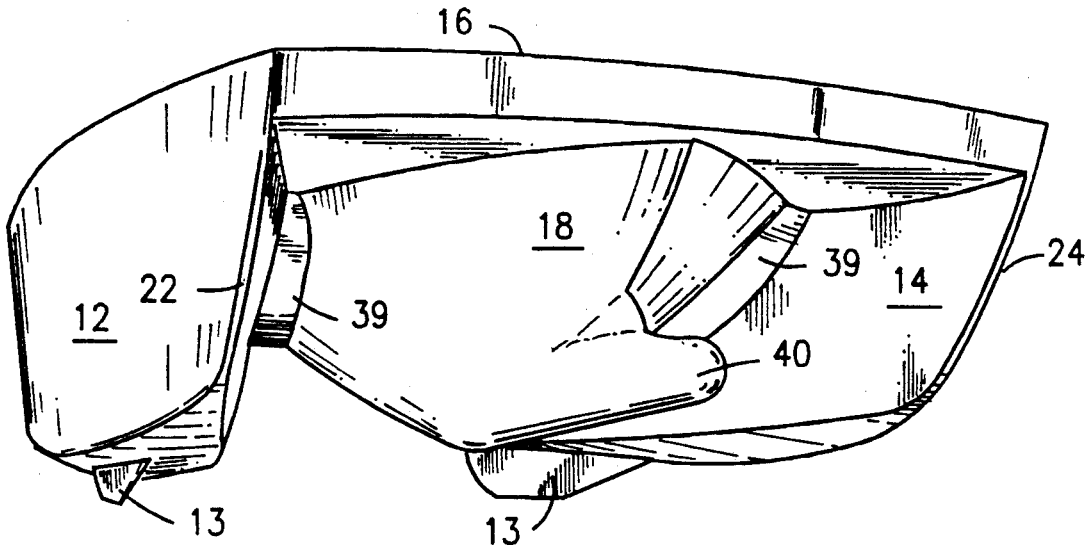
FIG. 6 is a frontal perspective view of a second embodiment thereof.
Figure 7:
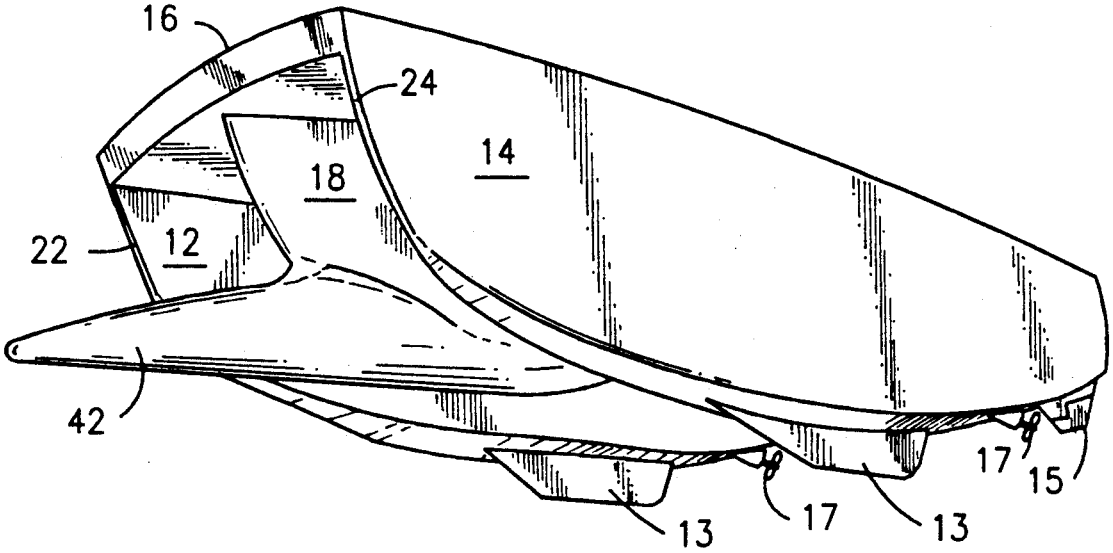
FIG. 7 is a three-quarter frontal perspective view of a third embodiment.

The second embodiment, depicted in FIG. 6, includes a bulbous nose 40 formed integrally with the leading end of the third hull; it may be fully or partially submerged, depending upon the performance characteristics desired. FIG. 7 shows a sharp, wave-piercing nose 42; this nose is conical or missile-tip shaped and may also be partially or fully submerged dependent upon design considerations.

A motor and propeller could also be provided in the novel central hull, as either the primary and sole propulsion unit or as a third engine and propeller installation.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A watercraft, comprising:

a pair of laterally spaced apart, parallel, longitudinally aligned hulls;

said hulls having a common predetermined length and width;

said common predetermined length being equal to the length of the watercraft;

a third hull disposed between said pair of hulls, in equidistantly spaced relation thereto;

said third hull being submerged in water to a similar extent as said pair of hulls when the watercraft is at rest and floating in a body of water;

said third hull having a predetermined longitudinal extent that is less than said common predetermined length of said pair of hulls;

said third hull and each hull of said pair of hulls having a common height extent, all of said hulls having a bottom edge disposed in a common horizontal plane;

a deck disposed in overlying relation to said pair of hulls and to said third hull;

said deck having a length substantially equal to the length of each hull of said pair of hulls;

said deck having a predetermined thickness;

a recess of predetermined depth and predetermined geometrical configuration formed in an underside of said deck aft of said third hull;

said recess being formed between said pair of hulls;

said pair of hulls and said third hull remaining substantially submerged when said watercraft is underway, said watercraft being of the non-planing type;

a rooster tail being created by said third hull when said watercraft is underway;

said recess receiving substantially all of said rooster tail so that water forming said rooster tail does not appreciably impinge against the underside of said deck even when said watercraft is underway; and said third hull having a leading end disposed substantially coincident with leading ends of each hull of said pair of hulls.

2. The watercraft of claim 1, wherein said predetermined longitudinal extent of said third hull is about two-thirds the common length of said pair of hulls.

3. The watercraft of claim 1, further comprising a dished section formed in each side of said third hull to accommodate said pair of hulls.

4. A watercraft, comprising:

a pair of laterally spaced apart, parallel, longitudinally aligned hulls;

said hulls having a common predetermined length;

said common predetermined length being equal to the length of the watercraft;

a third hull disposed between said pair of hulls, in equidistantly spaced relation thereto;

said third hull being submerged in water to a similar extent as said pair of hulls when the watercraft is at rest and floating in a body of water;

said third hull and said pair of hulls having a common height extent, all of said hulls having a bottom edge disposed in a common horizontal plane;

said pair of hulls and said third hull remaining substantially submerged when said watercraft is underway, said watercraft being of the non-planing type;

a rooster tail being created by said third hull when said watercraft is underway;

said third hull having a longitudinal extent that is about two-thirds the common length of said pair of hulls;

a deck disposed in overlying relation to said pair of hulls and to said third hull;

said deck having a length substantially equal to the length of each hull of said pair of hulls;

said deck having a predetermined thickness;

a recess of predetermined depth and predetermined geometrical configuration formed in an underside of said deck aft of said third hull;

said recess being formed between said pair of hulls;

said recess receiving substantially all of said rooster tail so that water forming said rooster tail does not appreciably impinge against the underside of said deck even when said watercraft is underway;

said third hull having a leading end disposed substantially coincident with leading ends of said pair of hulls; and a dished section formed in each side of said third hull to accommodate said pair of hulls.

* * * * *